US008664868B2

(12) United States Patent
Liu et al.

(10) Patent No.: US 8,664,868 B2
(45) Date of Patent: Mar. 4, 2014

(54) IMAGE PROCESSING CIRCUIT AND LIGHT ILLUMINATION MODULE

(75) Inventors: Chia-Chun Liu, Hsinchu County (TW); Chung-Wen Wu, Yilan County (TW); Chien-Cheng Tu, Hsinchu (TW); Sih-Ting Wang, Kaohsiung (TW)

(73) Assignee: Novatek Microelectronics Corp., Hsinchu (TW)

( * ) Notice: Subject to any disclaimer, the term of this patent is extended or adjusted under 35 U.S.C. 154(b) by 94 days.

(21) Appl. No.: 13/294,180

(22) Filed: Nov. 11, 2011

(65) Prior Publication Data

US 2012/0268022 A1 Oct. 25, 2012

Related U.S. Application Data

(60) Provisional application No. 61/478,063, filed on Apr. 22, 2011.

(30) Foreign Application Priority Data

Jun. 24, 2011 (TW) ..... 100122274 A

(51) Int. Cl.
*H05B 37/02* (2006.01)

(52) U.S. Cl.
USPC ..... 315/185 R; 315/224; 315/297; 315/307

(58) Field of Classification Search
None
See application file for complete search history.

(56) References Cited

U.S. PATENT DOCUMENTS

2010/0194301 A1* 8/2010 Okubo ..... 315/224
2010/0301751 A1* 12/2010 Chobot et al. ..... 315/86

FOREIGN PATENT DOCUMENTS

TW I291311 12/2007
TW M343888 11/2008
TW M391250 10/2010

OTHER PUBLICATIONS

"Office Action of Taiwan counterpart application" issued on Nov. 19, 2013, p. 1-p. 3.

* cited by examiner

*Primary Examiner* — Jany Richardson
(74) *Attorney, Agent, or Firm* — Jianq Chyun IP Office

(57) ABSTRACT

An image processing circuit and a light illumination module are provided. The light illumination module has an integrated circuit and a plurality of light emitting diode (LED) strings connected in parallel. The integrated circuit could be the image processing circuit. Each of the LED strings has a plurality of LEDs connected in series. The integrated circuit has a driving circuit coupled to the LED strings. The driving circuit supplies a driving voltage to first ends of the LED strings to drive the LED strings. The driving circuit is also configured to maintain a voltage value of the driving voltage obtained while all of the strings of the light emitting diodes are turned on, until all of the LED strings are turned on again. Accordingly, the interference of the LED strings is decreased, and the LED strings operate more stably.

15 Claims, 6 Drawing Sheets

IMAGE PROCESSING CIRCUIT AND LIGHT ILLUMINATION MODULE

CROSS-REFERENCE TO RELATED APPLICATION

This application claims the priority benefits of U.S. provisional application Ser. No. 61/478,063, filed on Apr. 22, 2011 and Taiwan application serial no. 100122274, filed on Jun. 24, 2011. The entirety of each of the above-mentioned patent applications is hereby incorporated by reference herein and made a part of this specification.

BACKGROUND OF THE INVENTION

1. Field of the Invention

The invention relates to an image processing circuit and a light illumination module. More particularly, the invention relates to an image processing circuit controlling a backlight of a liquid crystal display (LCD) and a light illumination module providing the backlight of the LCD.

2. Description of Related Art

Light emitting diodes (LEDs) are generally used as light sources, for example, used as a backlight module of a liquid crystal display (LCD), a mobile phone, a portable computer and a personal digital assistant (PDA), etc. The backlight module is a key component used for driving a light source in a display, which not only determines reliability and stability of the display, but also influences display quality of the display.

Generally, to facilitate a user adjusting brightness of the light source or save more power under ambient light, a good dimming ability has to be achieved. In view of physical properties of the LED, a current flowing through the LED and a forward bias of the LED have an exponential relationship, while a lighting degree of the LED is proportional to the current flowing there through. In other words, the greater the current flowing through the LED is, the higher the brightness of the LED is. Commonly used dimming methods include an analog dimming method and a digital dimming method. The analog dimming method is to adjust a magnitude of a forward current flowing through the LED to achieve brightness variation. In the digital dimming method, the LED is controlled to be turned on/off, and based on a visual persistence principle of human eyes, an average brightness is controlled by adjusting a duty cycle for turning on/off the LED. Although the analog dimming method is easy to be implemented, an external circuit has to be added, which increase a system cost. Therefore, the digital dimming method is a current development trend.

Referring to FIG. 1, FIG. 1 is a schematic diagram of a conventional light illumination module 100. The light illumination module 100 can be used to provide a backlight for an LCD, which has a scaler 112 and a driving circuit 122. The scaler 112 and the driving circuit 122 are respectively formed in different integrated circuit (IC) chips, and are respectively disposed on a scaler circuit board 110 and a driving circuit board 120. The scaler 112 receives an image signal $S_{IMG}$, and converts a resolution of the image signal $S_{IMG}$ from a first resolution to a second resolution, so as to generate and output a control signal DIM[1:4] to the driving circuit 122. The control signal DIM[1:4] is a digital signal of four bits, and each of the four bits is used for controlling a corresponding LED string 160. Each of the LED strings 160 has a plurality of LEDs 162.

Referring to FIG. 1 and FIG. 2, FIG. 2 is a timing diagram of each bit of the control signal DIM[1:4] and a driving voltage $V_{OUT}$. Each of the bits DIM[1]-DIM[4] is used to turn on/off the corresponding LED string 160. Further, when a value of any of the bits DIM[1]-DIM[4] is "1" (a high level), the corresponding LED string 160 is turned on, and when the value of any of the bits DIM[1]-DIM[4] is "0" (a low level), the corresponding LED string 160 is turned off.

However, since the driving circuit 122 controls the driving voltage $V_{OUT}$ according to sampled voltages of the second ends B of the LED strings 160, and since the voltages of the second ends B are different due to different turning on/off states of the LED strings 160, the voltages of the second ends B sampled by the driving circuit 122 each time are different, so that a voltage value of the driving voltage $V_{OUT}$ is constantly varied. However, the constant variation of the voltage value of the driving voltage $V_{OUT}$ leads to a result that the driving voltage $V_{OUT}$ itself becomes a noise source. In this case, the noise of the light illumination module 100 is increased, and intensity of light provided by the light illumination module 100 is unstable.

SUMMARY OF THE INVENTION

The invention is directed to an image processing circuit and a light illumination module, in which a sampling operation of end voltages is performed only when all of light emitting diode (LED) strings are turned on, so as to reduce noise of the light illumination module and stabilize light intensity of the light illumination module.

The invention provides a light illumination module including a plurality of light emitting diode (LED) strings connected in parallel and an integrated circuit. Each of the LED strings includes a plurality of LEDs connected in series. The integrated circuit includes a driving circuit. The driving circuit is coupled to the LED strings for supplying a driving voltage to first ends of the LED strings to drive the LED strings. The driving circuit is also configured to maintain a voltage value of the driving voltage obtained when all of the LED strings are turned on, until the LED strings are turned on again.

The invention provides an image processing circuit, adapted to drive a plurality of light emitting diode (LED) strings. The image processing circuit includes a driving circuit, and the driving circuit is coupled to the LED strings for supplying a driving voltage to first ends of the LED strings to drive the LED strings. The driving circuit is also configured to maintain a voltage value of the driving voltage obtained when all of the LED strings are turned on, until all of the LED strings are turned on again.

In an embodiment of the invention, the integrated circuit further includes a scaler. The scaler is coupled to the driving circuit for processing an image signal to generate and output a control signal to the driving circuit, and the driving circuit controls operations of the LED strings according to the control signal.

In an embodiment of the invention, the scaler converts a resolution of the image signal from a first resolution to a second resolution.

In an embodiment of the invention, the scaler includes a register for storing data. When the driving circuit detects operation abnormity of the LED strings, the driving circuit stores abnormal information of the LED strings to the register.

In an embodiment of the invention, when the driving circuit detects the operation abnormity of the LED strings, the driving circuit turns off the LED strings, and the scaler continually operates.

In an embodiment of the invention, the scaler includes a reference voltage circuit for providing a reference voltage to the driving circuit, where the driving circuit generates the driving voltage according to the reference voltage.

In an embodiment of the invention, the driving circuit controls a duty cycle of each of the LED strings according to the control signal.

In an embodiment of the invention, the integrated circuit is a single chip.

In an embodiment of the invention, the driving circuit includes a sampling circuit and a pulse width modulation (PWM) circuit. The sampling circuit is used for sampling voltages of second ends of the LED strings when all of the LED strings are turned on, and generates a control voltage according to the sampled voltages. The PWM circuit controls the voltage value of the driving voltage according to the control voltage.

In an embodiment of the invention, the light illumination module is used for providing a backlight for a liquid crystal display (LCD).

According to the above descriptions, the driving circuit of the light illumination module samples the end voltages only when all of the LED strings are turned on, so that variation of the driving voltage of the driving circuit will not produce a noise source, and accordingly the noise of the light illumination module can be reduced, and the light intensity of the light illumination module is stabilized. Moreover, the scaler and the driving circuit can be integrated into a single chip, by which application flexibility of the LEDs is greatly enhanced, and regarding a supporting degree of a displayed image, better instantaneity and application flexibility can be achieved.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
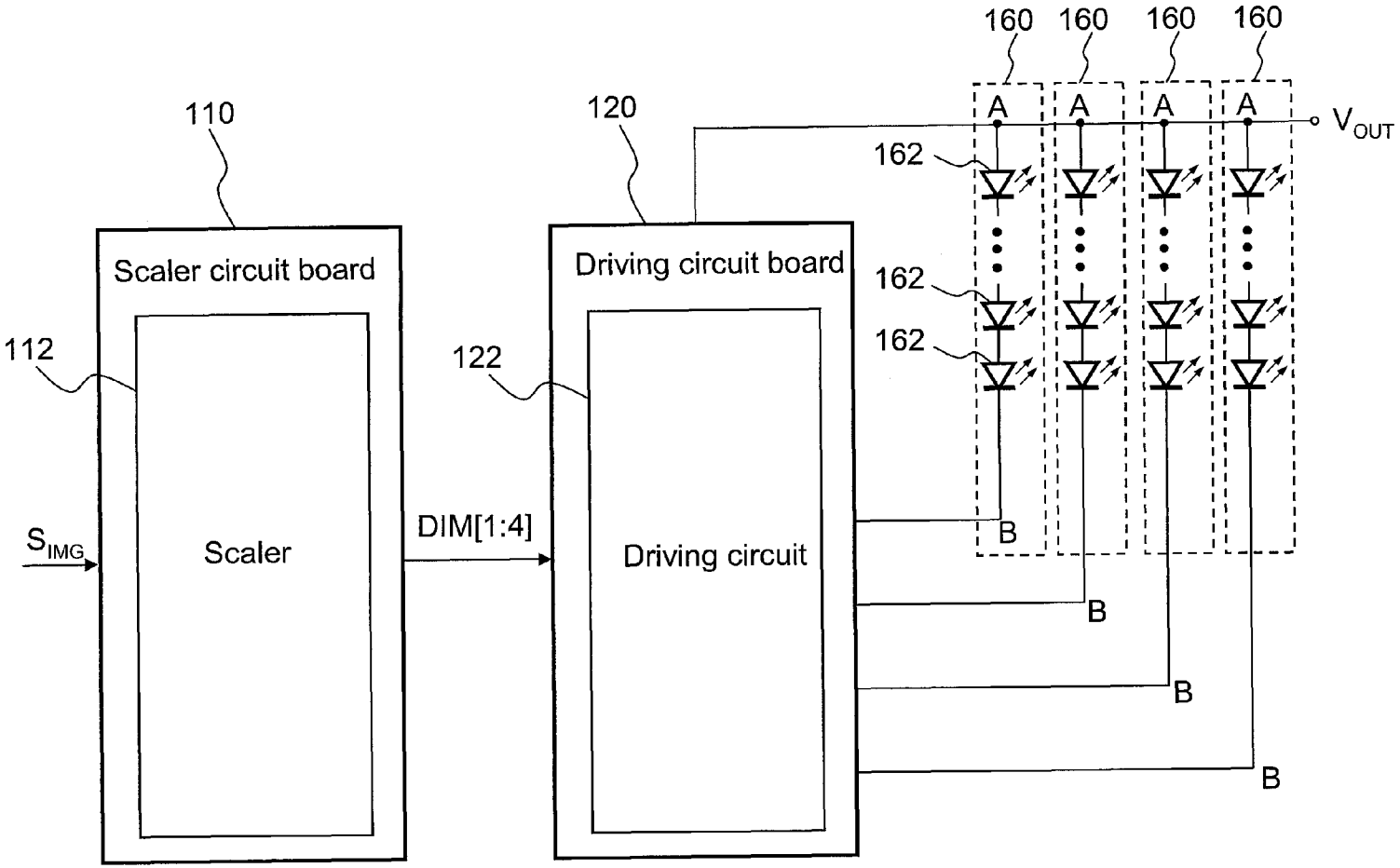
FIG.1 (Related Art)
FIG. 1 is a schematic diagram of a conventional light illumination module.
Figure 2:
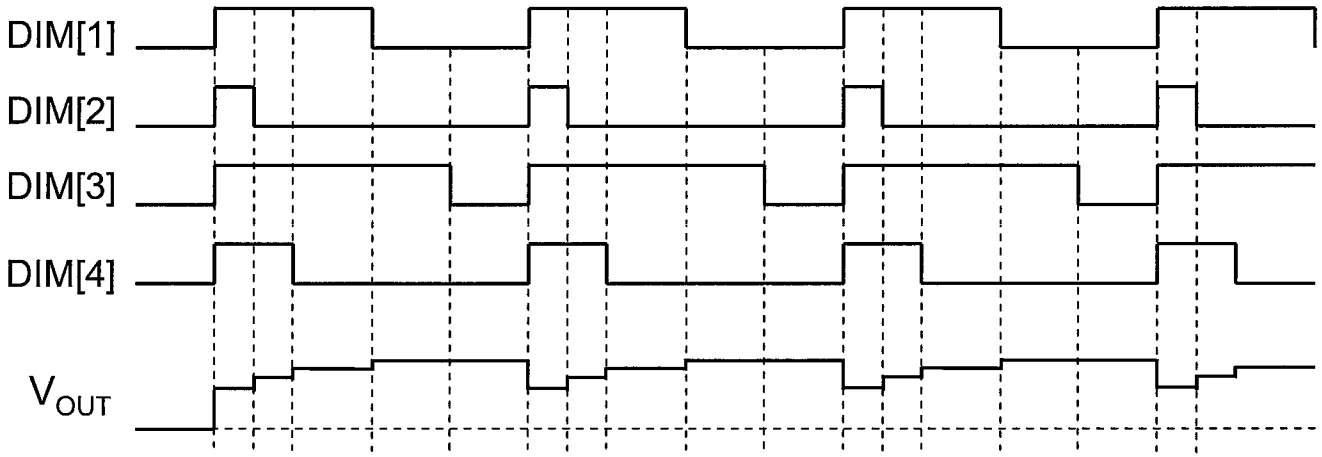
FIG.2 (Related Art)
FIG. 2 is a timing diagram of each bit of a control signal and a driving voltage of FIG. 1
Figure 3:
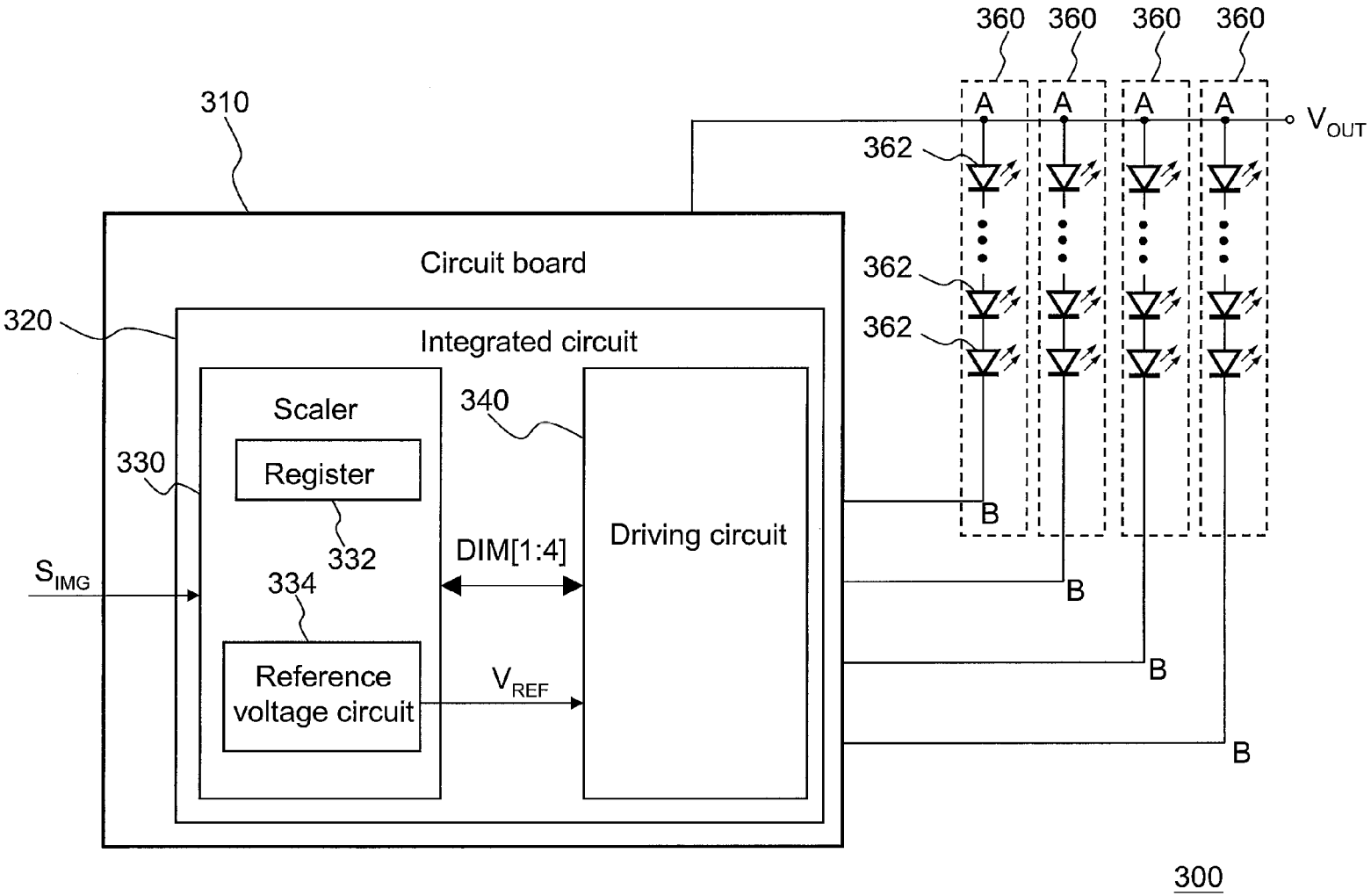
FIG. 3 is a schematic diagram of a light illumination module according to an embodiment of the invention.

Referring to FIG. 3, FIG. 3 is a schematic diagram of a light illumination module 300 according to an embodiment of the invention. The light illumination module 300 is used for providing a backlight of a liquid crystal display (LCD), and has a scaler 330 and a driving circuit 340. In the present embodiment, the scaler 330 and the driving circuit 340 are integrated into a same integrated circuit 320, where the integrated circuit 320 is, for example, a single chip, and is disposed on a circuit board 310. However, the invention is not limited thereto. For example, in other embodiments, the scaler 330 is separated from the integrated circuit 320, and the scaler 330 and the driving circuit 340 are independently operated. For another example, the light illumination module does not include the scaler 330.

The light illumination module 300 further includes a plurality of light emitting diode (LED) strings 360, where each of the LED strings 360 includes a plurality of LEDs 362. In the present embodiment, the light illumination module 300 has four LED strings 360, though the invention is not limited thereto, and those skilled in the art should understand that the number of the LED strings of the light illumination module of the invention can be any number greater than 1.

In the present embodiment, the scaler 330 is coupled to the driving circuit 340 for processing an image signal $S_{IMG}$ so as to generate and output a control signal DIM[1:4] to the driving circuit 340. The driving circuit 340 controls operations of the LED strings 360 according to the control signal DIM[1:4]. Moreover, the scaler 330 converts a resolution of the image signal $S_{IMG}$ from a first resolution to a second resolution. In the present embodiment, the control signal DIM[1:4] is a digital signal of four bits, where each bit is used for controlling the operation of a corresponding one of the LED strings 360. Each of the LED strings 360 has a plurality of the LEDs 362. It should be noticed that in the present embodiment, the bit number of the control signal DIM[1:4] generated by the scaler 330 is equal to the number of the LED strings 360. In other embodiments of the invention, a bit number of the control signal received by the driving circuit for controlling operations of the LED strings is equal to the number of the LED strings.

Figure 4:
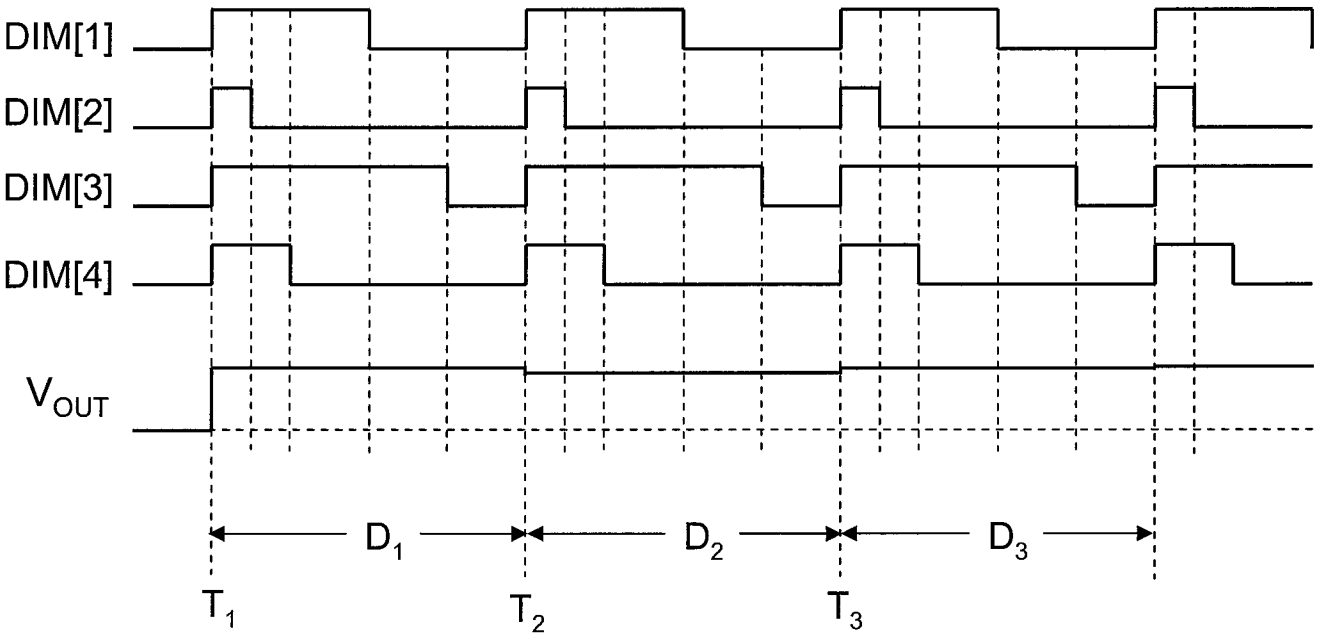
FIG. 4 is a timing diagram of each bit of a control signal and a driving voltage of FIG. 3.

The driving circuit 340 is coupled to the LED strings 360 for supplying a driving voltage $V_{OUT}$ to first ends A of the LED strings 360 for driving the LED strings 360. Referring to FIG. 3 and FIG. 4, FIG. 4 is a timing diagram of each bit of the control signal DIM[1:4] and a driving voltage $V_{OUT}$. Each of the bits DIM[1]-DIM[4] is used to turn on/off the corresponding LED string 360. Further, when a value of any of the bits DIM[1]-DIM[4] is "1" (a high level), the corresponding LED string 360 is turned on, and when the value of any of the bits DIM[1]-DIM[4] is "0" (a low level), the corresponding LED string 360 is turned off. Therefore, the driving circuit 340 can control a duty cycle of each of the LED strings 360 according to the control signal DIM[1:4].

The driving circuit 340 maintains a voltage value of the driving voltage $V_{OUT}$ obtained when all of the LED strings 360 are turned on, until all of the LED strings 360 are turned on again. Taking FIG. 4 as an example, the driving circuit 340 maintains the voltage value of the driving voltage $V_{OUT}$ during time intervals D1, D2 and D3 respectively, and the voltage values of the driving voltage $V_{OUT}$ maintained during the time intervals D1, D2 and D3 are respectively equal to voltage values of the driving voltage $V_{OUT}$ at time points $T_1$, $T_2$ and $T_3$, and all of the LED strings 360 are turned on at the time points $T_1$, $T_2$ and $T_3$.

In this way, the driving voltage $V_{OUT}$ supplied to the LED strings 360 by the driving circuit 340 can be maintained unchanged for a long time, so as to avoid producing a noise source to interfere other circuits, and rapid change of currents flowing through the LED strings 360 is avoided.

Referring to FIG. 3, in another embodiment, the scaler 330 includes a register 332 for storing data. When the driving circuit 340 detects operation abnormity of the LED strings 360, the driving circuit stores abnormal information of the LED strings 360 into the register 332. Moreover, in an embodiment of the invention, when the driving circuit 340 detects the operation abnormity of the LED strings 360, the driving circuit 340 turns off the LED strings 360, and the scaler 330 continually operates. In this way, when the LED strings 360 have operation abnormity, the LED strings 360 can be turned off in time, and the abnormal information stored in the register 332 can be read out for subsequent error correction or maintenance.

In an embodiment of the invention, the scaler 330 further includes a reference voltage circuit 334. The reference voltage circuit 334 provides a reference voltage $V_{REF}$ to the driving circuit 340, and the driving circuit 340 generates the driving voltage $V_{OUT}$ according to the reference voltage $V_{REF}$. In the present embodiment, a voltage value of the reference voltage $V_{REF}$ provided by the reference voltage circuit 334 can be adjusted according to an actual design requirement. For example, the reference voltage circuit 334 can provide the reference voltage $V_{REF}$ with a suitable voltage value to the driving circuit 340 according to different numbers of the LED strings 360, so as to achieve desired light intensity of the LED strings 360.

Figure 5:
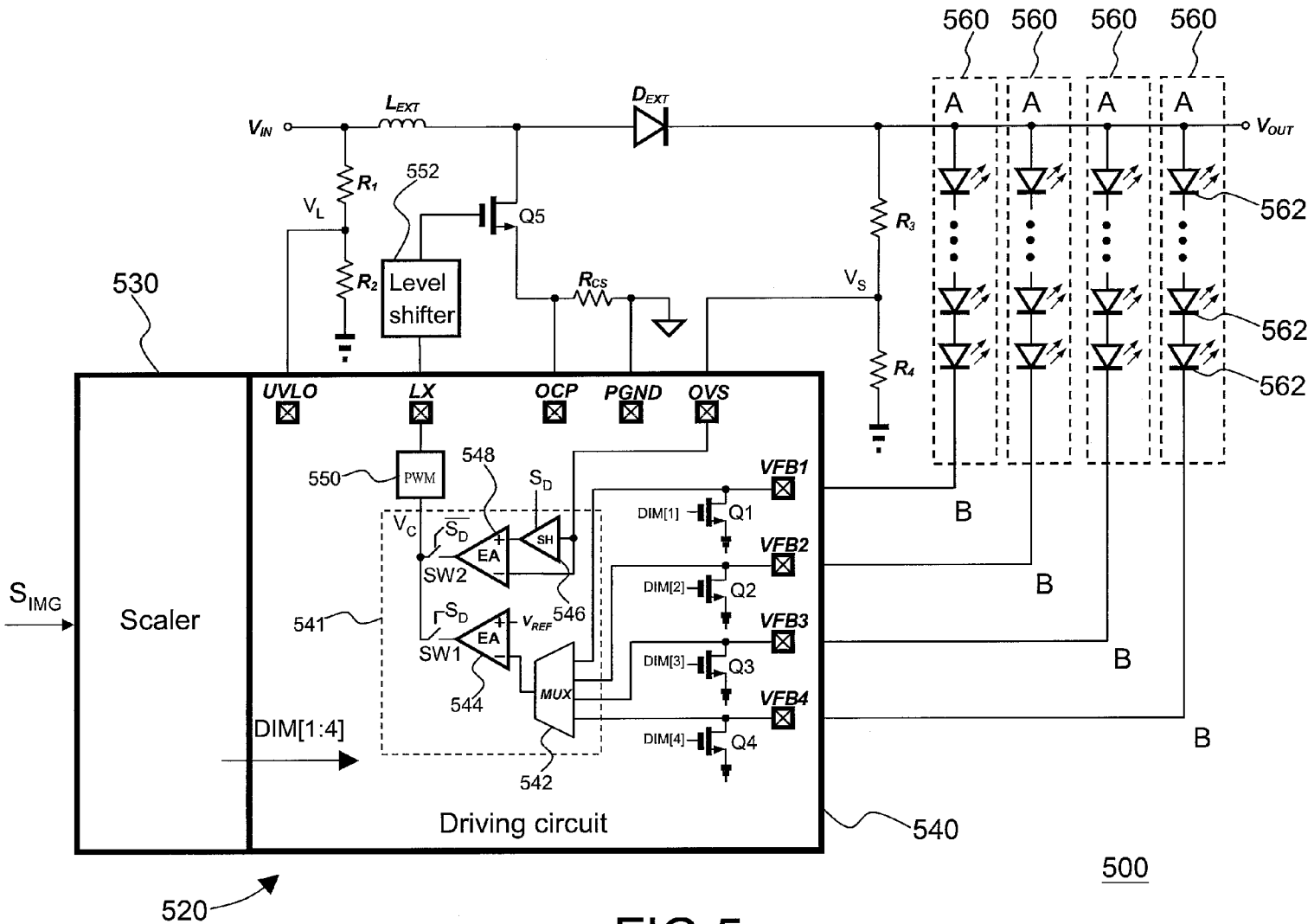
FIG. 5 is a schematic diagram of a light illumination module according to an embodiment of the invention.

Referring to FIG. 5, FIG. 5 is a schematic diagram of a light illumination module 500 according to an embodiment of the invention. Similar to the light illumination module 300, the light illumination module 500 can also provide a backlight for an LCD, and has a scaler 530 and a driving circuit 540. In the present embodiment, the scaler 530 and the driving circuit 540 are integrated into a same integrated circuit 520, where the integrated circuit 520 is, for example, a single chip. However, the invention is not limited thereto. For example, in other embodiments, the scaler 530 is separated from the integrated circuit 520, and the scaler 530 and the driving circuit 540 are independently operated. For another example, the light illumination module does not include the scaler 530.

The light illumination module 500 further includes a plurality of LED strings 560, where each of the LED strings 560 includes a plurality of LEDs 562. In the present embodiment, the light illumination module 500 has four LED strings 560, though the invention is not limited thereto, and those skilled in the art should understand that the number of the LED strings of the light illumination module of the invention can be any number greater than or equal to 2.

In the present embodiment, the scaler 530 is coupled to the driving circuit 540 for processing the image signal $S_{IMG}$ so as to generate and output the control signal DIM[1:4] to the driving circuit 540. The driving circuit 540 controls operations of the LED strings 560 according to the control signal DIM[1:4]. Moreover, the scaler 530 converts a resolution of the image signal $S_{IMG}$ from the first resolution to the second resolution. In the present embodiment, the control signal DIM[1:4] is a digital signal of four bits, where each bit is used for controlling the operation of the corresponding LED string 560. Each of the LED strings 560 has a plurality of the LEDs 562. In the present embodiment, the bit number of the control signal DIM[1:4] generated by the scaler 530 is equal to the number of the LED strings 360.

Figure 6:
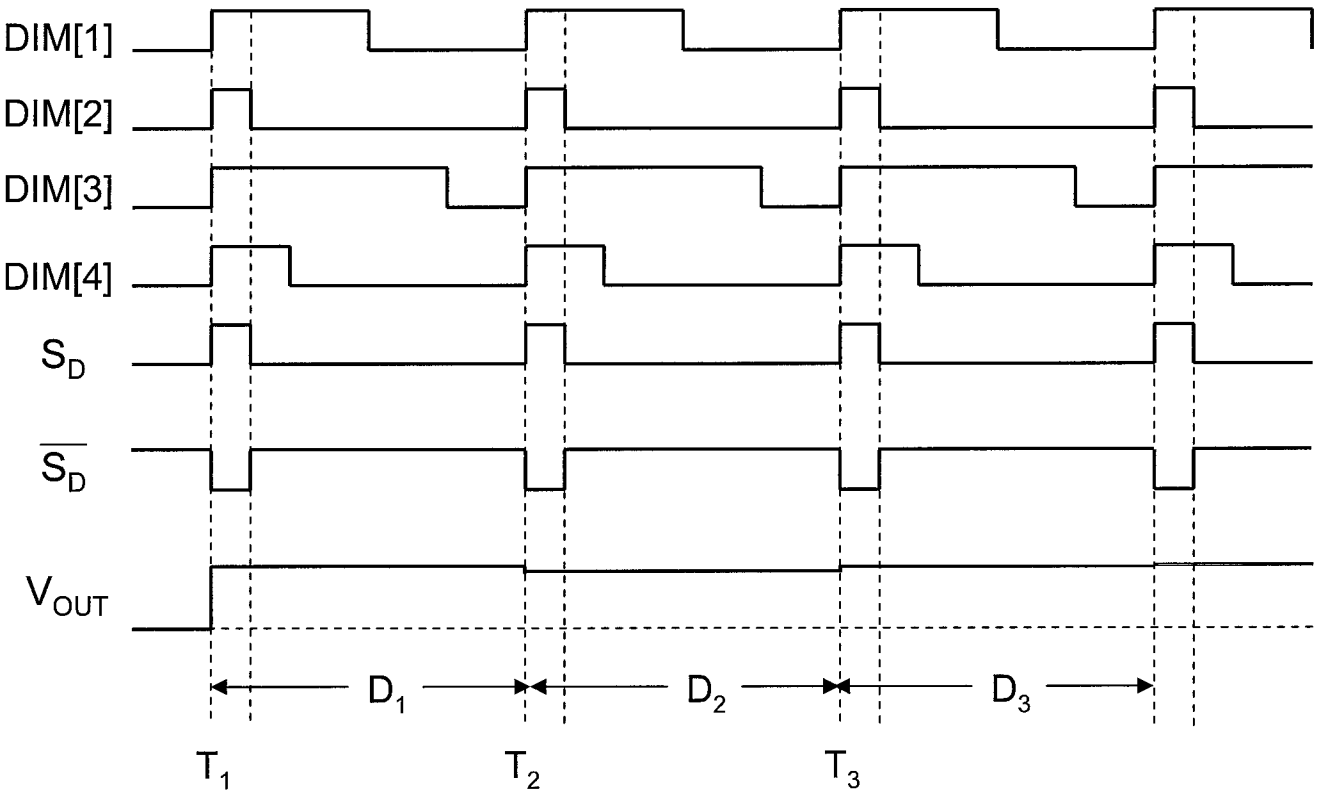
FIG. 6 is a timing diagram of each bit of a control signal and a driving voltage of FIG. 5.

The driving circuit 540 is coupled to the LED strings 560 for supplying the driving voltage $V_{OUT}$ to the first ends A of the LED strings 560 for driving the LED strings 560. Referring to FIG. 5 and FIG. 6, FIG. 6 is a timing diagram of each bit of the control signal DIM[1:4] and the driving voltage $V_{OUT}$. Each of the bits DIM[1]-DIM[4] is used to turn on/off the corresponding LED string 560. Further, when a value of any of the bits DIM[1]-DIM[4] is "1" (a high level), the corresponding LED string 560 is turned on, and when the value of any of the bits DIM[1]-DIM[4] is "0" (a low level), the corresponding LED string 560 is turned off. Therefore, the driving circuit 540 can control a duty cycle of each of the LED strings 560 according to the control signal DIM[1:4].

The driving circuit 540 maintains a voltage value of the driving voltage $V_{OUT}$ obtained when all of the LED strings 560 are turned on, until all of the LED strings 560 are turned on again. Taking FIG. 6 as an example, the driving circuit 540 maintains the voltage value of the driving voltage $V_{OUT}$ during time intervals D1, D2 and D3 respectively, and the voltage values of the driving voltage $V_{OUT}$ maintained during time intervals D1, D2 and D3 are respectively equal to voltage values of the driving voltage $V_{OUT}$ at time points $T_1$, $T_2$ and $T_3$, and all of the LED strings 560 are turned on at the time points $T_1$, $T_2$ and $T_3$.

In this way, the driving voltage $V_{OUT}$ supplied to the LED strings 560 by the driving circuit 540 can be maintained unchanged for a long time, so as to avoid producing a noise source to interfere other circuits, and rapid change of currents flowing through the LED strings 560 is avoided.

In an embodiment of the invention, the driving circuit 540 includes a sampling circuit 541 and a pulse width modulation (PWM) circuit 550. The sampling circuit 541 samples voltages of the second ends B of the LED strings 560 when all of the LED strings 560 are turned on, and the sampling circuit 541 generates a control voltage $V_C$ according to the sampled voltages. The PWM circuit 550 controls the voltage value of the driving voltage $V_{OUT}$ according to the control voltage $V_C$.

In an embodiment of the invention, the driving circuit 540 further includes a first transistor Q1, a second transistor Q2, a third transistor Q3 and a fourth transistor Q4, where gates thereof are respectively controlled by one bit of the control signal DIM[1:4], and drains thereof are respectively connected to the second ends B of the corresponding LED strings 560 through pins VFB1, VFB2, VFB3 and VFB4. The sampling circuit 541 further includes a multiplexer 542, a first error amplifier 544, a sample-and-hold circuit 546 and a second error amplifier 548. The multiplexer 542 selects and outputs a minimum one of the voltages of the second ends B of the LED strings 560. The first error amplifier 544 outputs a corresponding voltage according to the reference voltage $V_{REF}$ and the voltage output by the multiplexer 542. The sample-and-hold circuit 546 is controlled by an adjusting signal $S_D$. When the adjusting signal $S_D$ has a high potential, the sample-and-hold circuit 546 samples a first divided voltage $V_S$, and when the adjusting signal $S_D$ has a low potential, the sample-and-hold circuit 546 holds the sampled first divided voltage $V_S$. The second error amplifier 548 outputs a corresponding voltage according to the sampled first divided voltage $V_S$ of the sample-and-hold circuit 546 and the first divided voltage $V_S$. The sampling circuit 541 further includes a first switch SW1 and a second switch SW2, where the first switch SW1 is coupled to an output terminal of the first error amplifier 544 and is controlled by the adjusting signal $S_D$, and the second switch SW2 is coupled to an output terminal of the second error amplifier 548 and is controlled by a signal $\overline{S_D}$, where the signal $\overline{S_D}$ is a complementary signal of the adjusting signal $S_D$. Based on the above architecture, the sampling circuit 541 outputs the control voltage $V_C$ to the PWM circuit 550, and the PWM circuit 550 controls the voltage value of the driving voltage $V_{OUT}$ according to the control voltage $V_C$.

In an embodiment of the invention, the light illumination module 500 further includes a first resistor $R_1$ and a second resistor $R_2$ connected in series, which are for dividing an input voltage $V_{IN}$, and generating and outputting a second divided voltage $V_L$ to a pin UVLO of the driving circuit 540, where the input voltage $V_{IN}$ is a direct current (DC) voltage. Moreover, the light illumination module 500 further includes an inductor $L_{EXT}$ and a diode $D_{EXT}$. The inductor $L_{EXT}$ performs DCconversion on the input voltage $V_{IN}$, and the diode $D_{EXT}$ is used for rectification. The light illumination module 500 further includes a fifth transistor Q5 and a level shifter 552. The level shifter 552 is coupled to the PWM circuit 550 through a pin LX, and is used for shifting a level of the voltage output by the PWM circuit 550. The fifth transistor Q5 is turned on or off according to the output voltage level of the level shifter 552, so that a voltage of a drain of the fifth transistor Q5 is adjusted due to variation of the output voltage of the PWM circuit 550. The light illumination module 500 further includes a resistor $R_{CS}$, where one end of the resistor $R_{CS}$ is coupled to a source of the fifth transistor Q5 and a pin OCP of the driving circuit 540, and another end thereof is coupled to a pin PGND of the driving circuit 540. The driving circuit 540 determines a magnitude of a current flowing through the fifth transistor Q5 according to potentials of the pins OCP and PGND and a resistance of the resistor $R_{CS}$. The light illumination module 500 further includes a third resistor $R_3$ and a fourth resistor $R_4$ connected in series, which are used for dividing the driving voltage $V_{OUT}$, and generating and outputting the first divided voltage $V_S$ to the pin OVS of the driving circuit 540. In this way, the driving circuit 540 can determine the voltage values of the input voltage $V_{IN}$ and the driving voltage $V_{OUT}$ according to the first divided voltage $V_S$ and the second divided voltage $V_L$.

In another embodiment of the invention, an image processing circuit suitable for driving the LED strings 360 or 560 is provided. The image processing circuit can be the integrate circuit 320 of FIG. 3 or the integrated circuit 520 of FIG. 5, and the sampling operation of the end voltages is performed when all of the LED strings 360 or 560 are turned on, so as to reduce the noise of the light illumination module and stabilize the light intensity of the light illumination module. Detailed descriptions of the image processing circuit can refer to related descriptions of the integrated circuits 320 and 520, which are not repeated herein.

In summary, the driving circuit of the light illumination module samples the end voltages only when all of the LED strings are turned on, so that variation of the driving voltage of the driving circuit will not produce a noise source, and accordingly the noise of the light illumination module can be reduced, and the light intensity of the light illumination module is stabilized. Moreover, the scaler and the driving circuit can be integrated into a single chip, by which application flexibility of the LEDs is greatly enhanced, and regarding a supporting degree of a displayed image, better instantaneity and application flexibility can be achieved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A light illumination module, comprising:

a plurality of light emitting diode (LED) strings connected in parallel, wherein each of the LED strings comprises a plurality of light emitting diodes (LEDs) connected in series; and an integrated circuit, comprising:

a driving circuit, coupled to the LED strings, and supplying a driving voltage to first ends of the LED strings to drive the LED strings, wherein the driving circuit is configured to obtain a voltage value of the driving voltage when all of the LED strings are turned on and to maintain the voltage value of the driving voltage until all of the LED strings are turned on again.

2. The light illumination module as claimed in claim 1, wherein the integrated circuit further comprises:

a scaler, coupled to the driving circuit, and processing an image signal to generate and output a control signal to the driving circuit, wherein the driving circuit controls operations of the LED strings according to the control signal.

3. The light illumination module as claimed in claim 2, wherein the scaler converts a resolution of the image signal from a first resolution to a second resolution.

4. The light illumination module as claimed in claim 2, wherein the scaler comprises:

a register, storing data, wherein when the driving circuit detects operation abnormity of the LED strings, the driving circuit stores abnormal information of the LED strings to the register.

5. The light illumination module as claimed in claim 2, wherein when the driving circuit detects the operation abnormity of the LED strings, the driving circuit turns off the LED strings, and the scaler continually operates.

6. The light illumination module as claimed in claim 2, wherein the scaler comprises:

a reference voltage circuit, providing a reference voltage to the driving circuit, wherein the driving circuit generates the driving voltage according to the reference voltage.

7. The light illumination module as claimed in claim 2, wherein the driving circuit controls a duty cycle of each of the LED strings according to the control signal.

8. The light illumination module as claimed in claim 2, wherein the integrated circuit is a single chip.

9. The light illumination module as claimed in claim 1, wherein the driving circuit comprises:

a sampling circuit, sampling voltages of second ends of the LED strings when all of the LED strings are turned on, and generating a control voltage according to the sampled voltages; and a pulse width modulation (PWM) circuit, controlling the voltage value of the driving voltage according to the control voltage.

10. The light illumination module as claimed in claim 1, wherein the light illumination module is used for providing a backlight for a liquid crystal display (LCD).

11. An image processing circuit, adapted to drive a plurality of light emitting diode (LED) strings, the image processing circuit comprising:

a driving circuit, coupled to the LED strings, and supplying a driving voltage to first ends of the LED strings to drive the LED strings, wherein the driving circuit is configured to obtain a voltage value of the driving voltage when all of the LED strings are turned on and to maintain the voltage value of the driving voltage until all of the LED strings are turned on again.

12. The image processing circuit as claimed in claim 11, further comprising:

a scaler, coupled to the driving circuit, and processing an image signal to generate and output a control signal to the driving circuit, wherein the driving circuit controls operations of the LED strings according to the control signal.

13. The image processing circuit as claimed in claim 12, wherein the scaler converts a resolution of the image signal from a first resolution to a second resolution.

14. The image processing circuit as claimed in claim 12, wherein the scaler comprises:

a register, storing data, wherein when the driving circuit detects operation abnormity of the LED strings, the driving circuit stores abnormal information of the LED strings to the register.

15. The image processing circuit as claimed in claim 11, wherein the driving circuit comprises:

a sampling circuit, sampling voltages of second ends of the LED strings when all of the LED strings are turned on, and generating a control voltage according to the sampled voltages; and a pulse width modulation (PWM) circuit, controlling the voltage value of the driving voltage according to the control voltage.

* * * * *